US005887238A

United States Patent [19]

Matsuzoe et al.

[11] Patent Number: 5,887,238

[45] Date of Patent: Mar. 23, 1999

[54] TONER PRINTING MACHINE AND METHOD FOR FIXING TONER IMAGE

[75] Inventors: Hisanobu Matsuzoe, Chikushino; Kazuo Hakukawa, Fukuoka; Kouji Migita, Fukuoka-ken; Yasunori Sagara, Kasuga; Shinichi Kizu, Fukuoka; Yusuke Shiibara; Masashi Ogawa, both of Kasuga; Yukinori Hara, Fukuoka-ken, all of Japan

[73] Assignee: Matsushita Electric Industrial Co., Ltd., Osaka, Japan

[21] Appl. No.: 861,429

[22] Filed: May 21, 1997

[30] Foreign Application Priority Data

Jul. 26, 1996 [JP] Japan ..... 8-197204

[51] Int. Cl.[6] ..... G03G 15/20

[52] U.S. Cl. ..... 399/336; 219/216; 219/388

[58] Field of Search ..... 399/335, 336, 399/337, 320; 219/469–471, 216, 388; 430/97, 124

[56] References Cited

U.S. PATENT DOCUMENTS

| | | | |
|---|---|---|---|
| 3,700,218 | 10/1972 | Laisney | 432/62 |
| 4,021,641 | 5/1977 | Elter | 219/216 |
| 4,419,004 | 12/1983 | Kuehnle | 399/297 |
| 4,444,487 | 4/1984 | Miller et al. | 399/337 |
| 4,452,524 | 6/1984 | Parisi | 399/336 X |
| 4,661,431 | 4/1987 | Bujese et al. | 430/126 |
| 4,897,677 | 1/1990 | Lai | 399/159 X |
| 4,897,691 | 1/1990 | Dyer et al. | 399/336 X |
| 4,994,642 | 2/1991 | Matsumoto et al. | 399/335 X |
| 5,081,502 | 1/1992 | Mitsuya et al. | 399/336 |
| 5,113,223 | 5/1992 | Theodoulou et al. | 399/336 X |
| 5,428,434 | 6/1995 | Hirao | 399/336 |
| 5,488,452 | 1/1996 | Iwama | 399/335 X |

FOREIGN PATENT DOCUMENTS 0466129 1/1992 European Pat. Off. .

*Primary Examiner*—S. Lee

*Attorney, Agent, or Firm*—Stevens, Davis, Miller & Mosher, L.L.P.

[57] ABSTRACT

A toner printing machine includes an image forming device forming a toner image on a workpiece, and a heating member from which a heat energy is supplied to the toner image to be fixed to the workpiece, wherein the heating energy is supplied to the toner image while preventing a contact heat energy transmission between the heating member and the toner image.

24 Claims, 9 Drawing Sheets

TONER PRINTING MACHINE AND METHOD FOR FIXING TONER IMAGE

BACKGROUND OF THE INVENTION AND RELATED ART STATEMENT

The present invention relates to a toner printing machine comprising an image forming device forming a toner image on a workpiece, and a heating member from which a heat energy is transmitted to the toner image to be fixed to the workpiece.

In a toner printing machine disclosed by U.S. patent application Ser. No. 08/768,330 filed Dec. 17, 1996, a workpiece is moved intermittently in a workpiece transfer direction, and a toner image formation proceeds in a direction perpendicular to the workpiece transfer direction when the workpiece is stationary, so that a toner image is formed intermittently on the workpiece in the workpiece transfer direction. The toner image formed on the workpiece is fixed to the workpiece by being heated and pressed against the workpiece by a roller contacting the toner image.

OBJECT AND SUMMARY OF THE INVENTION

An object of the present invention is to provide a toner printing machine, in which a toner image is correctly and stably fixed to a workpiece.

According to one aspect of the present invention, a toner printing machine comprises an image forming device forming a toner image on a workpiece, and a heating member from which a heat energy is supplied or transmitted to the toner image to be fixed to the workpiece, and the heating energy is transmitted to the toner image while preventing a contact heat energy transmission between the heating member and the toner image.

Since the heating energy is supplied or transmitted to the toner image while preventing the contact heat energy transmission between the heating member and the toner image so that a pressing force between the heating member and the toner image for maintaining the contact (heat energy transmission) therebetween is not necessary on fixing the toner image to the workpiece, an adhesion of the toner to the heating member and an excessive penetration of the toner into the workpiece are prevented even when the workpiece stops relative to the heating member. Further, a cooling rate of the toner image after a stop or decrease of the heating energy supply is improved to control correctly a supplied amount of the heating energy or a supply time thereof by preventing the contact heat energy transmission between the heating member and the toner image in comparison with the contact heat energy transmission therebetween, because the toner image can be cooled or a temperature of the toner image can change independent of the heating member, and a heat radiation and/or gas-heatenergy-transmission from the toner image is performed by a space and/or gas (including the atmosphere) between the heating member and the toner image, that is, a time delay in temperature decrease of the heating member after the stop or decrease of the heating energy generation or supply of the heating member is isolated from the toner image. Therefore, the toner image is correctly and stably fixed to the workpiece by smooth and quick temperature decrease of the toner image independent of or thermally isolated from the heating member by the space and/or gas without the contact heat energy transmission between the heating member and the toner image.

The heat energy may be supplied or transmitted therebetween through a radiant heat energy transmission. The heating energy may be supplied or transmitted therebetween by the radiant heat energy transmission through a gas (for example, the atmosphere) between the heating member and the toner image, and/or by a heat energy conduction of the gas between the heating member and the toner image (=the toner image may be heated by the gas heated by the heating member).

When the heating member includes a radiant heat energy emitting member emitting a radiant heat energy toward the toner image, and a radiation interrupter member being movable relative to the radiant heat energy emitting member to interrupt at least partially the radiant heat energy so that an amount of the radiant heat energy to be supplied to the toner image is controlled according to a movement of the radiation interrupter member, the heat energy transmission therebetween, that is, a heat energy supply to the toner image can be quickly changed irrespective of a thermal capacity of the heating member causing a delay of temperature change thereof. A distance between the heating member and toner image may be variable to adjust quickly an amount of the heat energy to be supplied to the toner image. It is preferable for the heating member to include a reflection member reflecting the radiant heat energy to be directed toward the toner image.

A part of the workpiece facing to the image forming device may be moved intermittently in a workpiece transfer direction. A part of the workpiece facing to the heating member may be moved intermittently in the workpiece transfer direction synchronously with the intermittent movement of the part of the workpiece facing to the image forming device. The part of the workpiece facing to the heating member may be moved continuously in the workpiece transfer direction. The heating energy may be supplied or transmitted to the toner image on a part of the workpiece while the part of the is moving relative to the heating member. The heating energy may be supplied or transmitted to the toner image on a part of the workpiece while the part of the is substantially stationary relative to the heating member. A slack or bend of the workpiece as shown in FIG. 15, preferably projecting upward guided by a round guide surface under the workpiece may be formed between the image forming device and the heating member to absorb a difference between a movement of the part of the workpiece facing to the image forming device and a movement of another part of the workpiece facing to the heating member in the workpiece transfer direction.

When the heating member includes a radiant heat energy emitting member emitting a radiant heat energy, and a reflection and support member reflecting the radiant heat energy and supporting the workpiece thereon, and the toner image is arranged between the radiant heat energy emitting member and the reflection and support member so that a part of the radiant heat energy reaching the reflection and support member through the workpiece is returned to the toner image by the reflection and support member, a heating efficiency for the toner image is improved.

When the part of the workpiece facing to the heating member is moved intermittently relative to the heating member, it is preferable that the heat energy supply or transmission from the heating member to the toner image is maintained when the part of the workpiece facing to the heating member is moved relative to the heating member, and subsequently decreased by output decrease of the heating member and/or thermal transmission efficiency decrease between the heating member and the toner image before the part of the workpiece facing to the heating member stops relative to the heating member, so that the time delay in temperature decrease after the stop or decrease of the heating energy generation of the heating member is prevented from affecting the toner image as being stationary relative to the heating member.

When the part of the workpiece facing to the heating member is moved intermittently relative to the heating member, it is preferable that the heat energy supply or transmission from the heating member to the toner image (decreased or stopped when the part of the workpiece facing to the heating member is stationary relative to the heating member) is increased by output increase of the heating member and/or thermal transmission efficiency increase between the heating member and the toner image before the part of the workpiece facing to the heating member begins to move relative to the heating member, and subsequently maintained when the part of the workpiece facing to the heating member is moved relative to the heating member, so that a time delay in temperature increase after a start or increase of the heating energy generation of the heating member is prevented from affecting the toner image just after starting to move relative to the heating member.

When the part of the workpiece facing to the heating member is moved intermittently relative to the heating member, it is preferable that the heat energy supply or transmission from the heating member to the toner image is maintained when the part of the workpiece facing to the heating member is stationary relative to the heating member, and subsequently decreased by the output decrease of the heating member and/or the thermal transmission efficiency decrease between the heating member and the toner image before the part of the workpiece facing to the heating member begins to move relative to the heating member, so that the time delay in temperature decrease after the stop or decrease of the heating energy generation of the heating member is prevented from affecting the toner image just after starting to move relative to the heating member.

When the part of the workpiece facing to the heating member is moved intermittently relative to the heating member, it is preferable that the heat energy supply or transmission from the heating member to the toner image (decreased or stopped when the part of the workpiece facing to the heating member is moved relative to the heating member) is increased by the output increase of the heating member and/or the thermal transmission efficiency increase between the heating member and the toner image before the part of the workpiece facing to the heating member becomes stationary relative to the heating member, and subsequently maintained when the part of the workpiece facing to the heating member is stationary relative to the heating member, so that the time delay in temperature increase after the start or increase of the heating energy generation of the heating member is prevented from affecting the toner image as being stationary relative to the heating member.

It is preferable for the intermittent workpiece transfer relative to the heating member that the heat energy supply or transmission from the heating member to the toner image is restrained or decreased by the output decrease of the heating member and/or the thermal transmission efficiency decrease between the heating member and the toner image when the part of the workpiece facing to the heating member is being moved relative to the heating member, and the heat energy supply or transmission from the heating member to the toner image is not restrained when the part of the workpiece facing to the heating member is stationary relative to the heating member, for sufficient and even heat supply over the whole of the toner image.

When the heat energy transmission, that is, heat energy supply from the heating member to the toner image is performed with a heating width on the toner image, the toner image is formed intermittently toner-transfer-width by toner-transfer-width, and the heating width is not less than the toner-transfer-width in the workpiece transfer direction, the heat energy transmission during the workpiece movement relative to the heating member is not requisite for heat supply over the whole of the toner image.

When the heat energy supply or transmission from the heating member to the toner image is performed with a heating width on the toner image, the toner image is formed intermittently toner-transfer-width by toner-transfer-width, and the heating width is less than the toner-transfer-width in the workpiece transfer direction, a size and/or output power of the heating member can be decreased with the workpiece movement relative to the heating member during the heat supply to the toner image.

DETAILED DESCRIPTION OF PREFERRED EMBODIMENTS

Figure 1:
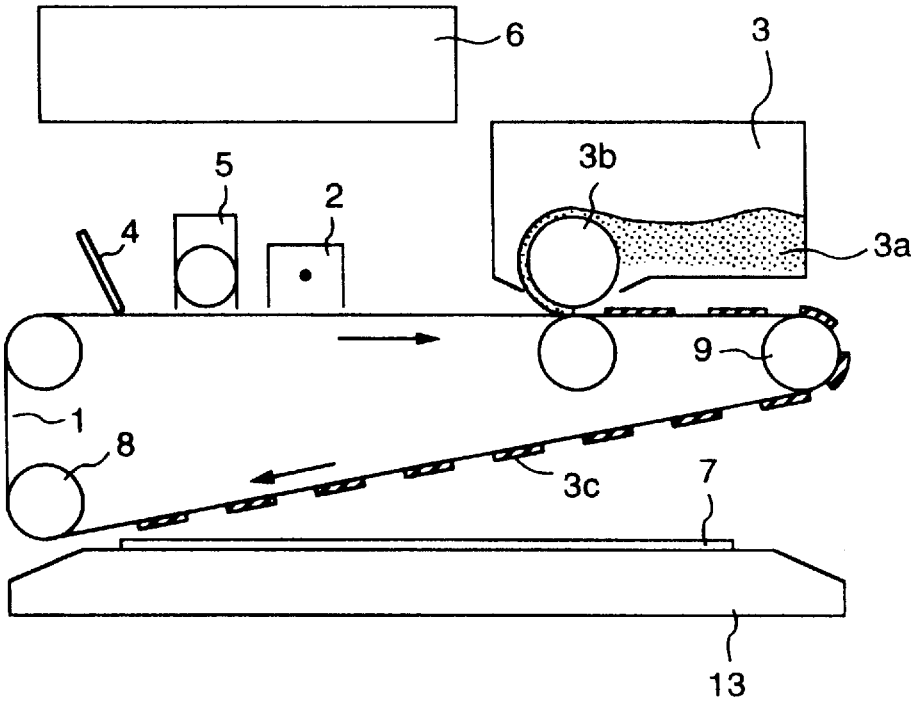
FIG. 1 is a schematic view showing a toner image forming device usable in a toner printing machine of the present invention.
Figure 2:
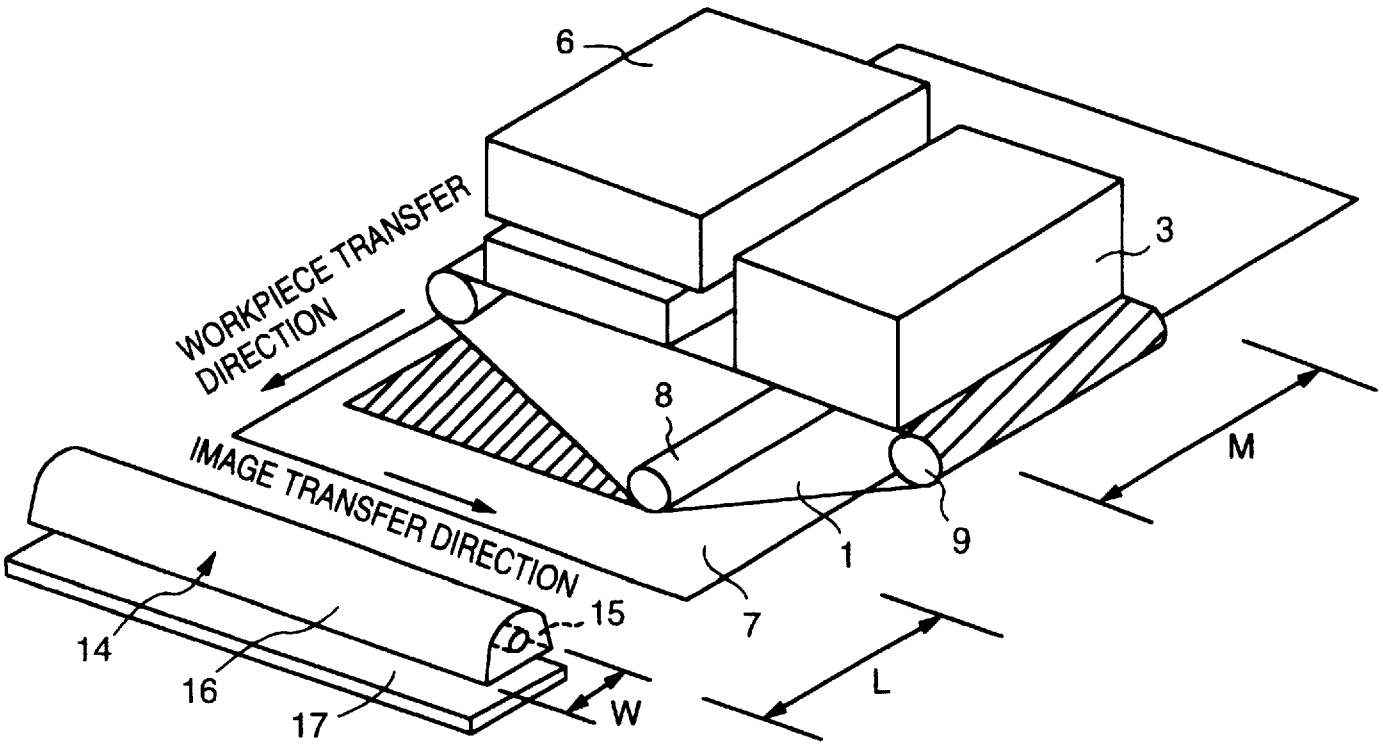
FIG. 2 is a schematic oblique projection view showing a toner printing machine according to the present invention.

In a toner printing machine as shown in FIGS. 1 and 2, a toner image carrier 1 with a photoconduction material layer thereon is surrounded by an electrifier 2, a toner image developing roller 3, a toner cleaning device 4, and an electrodischarger 5. An electrostatic latent image former 6 emits a light beam (for example, laser beam) to the photoconduction material layer to form an electrostatic latent image. According to a circulation of the toner image carrier 1 in a direction perpendicular to a transfer direction of a workpiece 7 as shown by an arrow, the toner image carrier 1 is electrified by the electrifier 2 at, for example −600 V, and subsequently is irradiated with the light beam from the electrostatic latent image former 6 to be electrically discharged partially to, for example, −100 V, so that the electrostatic latent image is formed by the partial electric discharge. The electrostatic latent image is developed by a toner 3*a* supplied to the toner image carrier 1 by a developing roller 3*b* so that a toner image 3*c* is formed on the toner image carrier 1.

Figure 3:
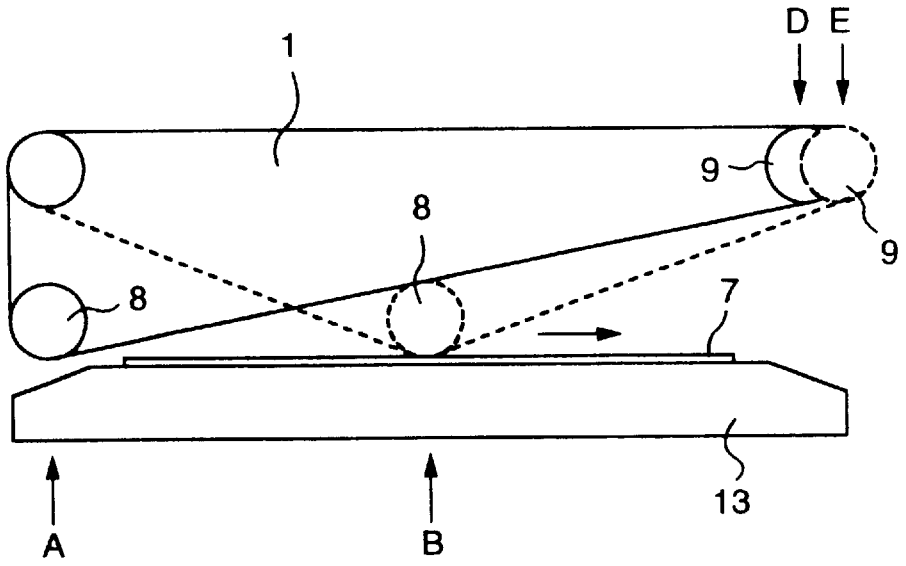
FIG. 3 is a schematic view showing a motion step of the toner image forming device.
Figure 4:
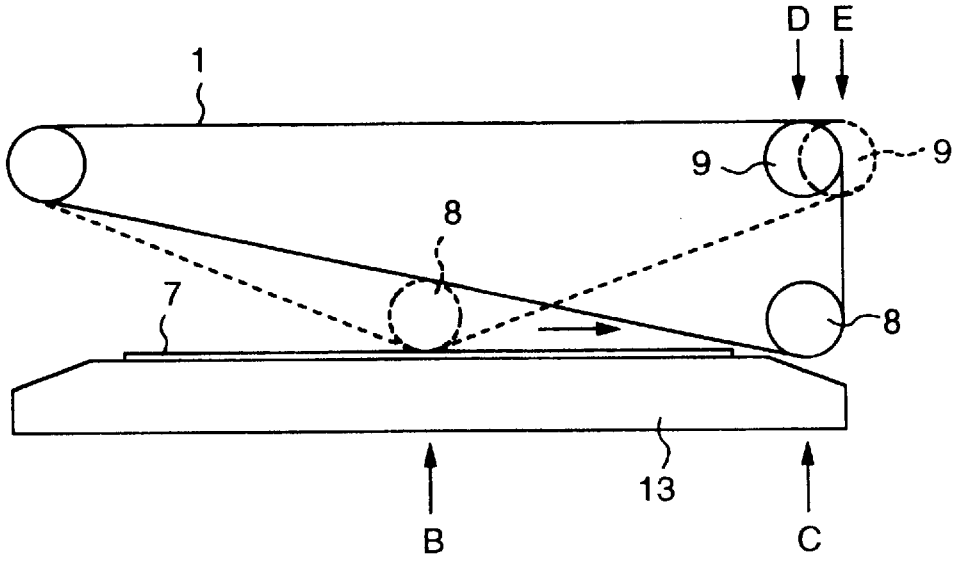
FIG. 4 is a schematic view showing another motion step of the toner image forming device.

As shown in FIGS. 3 and 4, the toner image carrier 1 is supported on at least three rollers. A image transfer roller 8 moves relative to the workpiece 7 with a contact pressing force for the workpiece 7 between the image transfer roller 8 and a transfer support plate 13 to transfer the toner image 3*c* from the toner image carrier 1 to the workpiece 7. A movable roller 9 moves horizontally according to a movement of the image transfer roller 8 to keep a tension of the toner image carrier 1. As shown in FIG. 3, while the image transfer roller 8 moves from a position A to a position B, the movable roller 9 moves from a position D to a position E. As shown in FIG. 3, while the image transfer roller 8 moves from the position B to a position C, the movable roller 9 moves from the position E to the position D. When the toner image carrier 1 circulates among the at least three rollers to form the toner image 3*c* on the toner image carrier 1, the image transfer roller 8 is stationary at the position A or C, and is rotated according to a circulation of the toner image carrier 1. When the image transfer roller 8 moves relative to the workpiece 7 in toner image transfer directions opposite to each other with a rotation thereof to transfer the toner image 3*c* from the toner image carrier 1 to the workpiece 7, the toner image carrier 1 is prevented from circulating, and the workpiece 7 is stationary in a workpiece transfer direction on the transfer support plate 13 electrified at a positive voltage to transfer the negatively electrified toner image 3*c* from the toner image carrier 1 to the workpiece 7. The toner image transfer directions are perpendicular to the workpiece transfer direction.

After the image transfer roller 8 reaches the position A or C to finish the toner image transfer of a toner image transfer width M, the workpiece 7 is transferred in the workpiece transfer direction by a workpiece transfer width L not more than the toner image transfer width M. A combination of the toner image transfer and the workpiece transfer is repeated to complete the whole of the toner image.

The toner cleaning device 4 includes a blade or brush to remove a remainder part of the toner on the toner image carrier 1 after the toner image transfer. The electrodischarger 5 releases the negative electrification of the toner image carrier 1 to be electrically neutral.

The workpiece 7 moves between a toner fixing device 14 generating a heat energy transmitted to the toner image through a radiant heat energy transmission and/or a gas or atmosphere heated by the toner fixing device 14 and a reflection and support member 17 on which the workpiece 7 slides to be supported. The radiant heat energy passes through the toner image 3*c* and the workpiece 7 is reflected by the reflection and support member 17 to return to and heat the toner image 3*c*.

Figure 5:
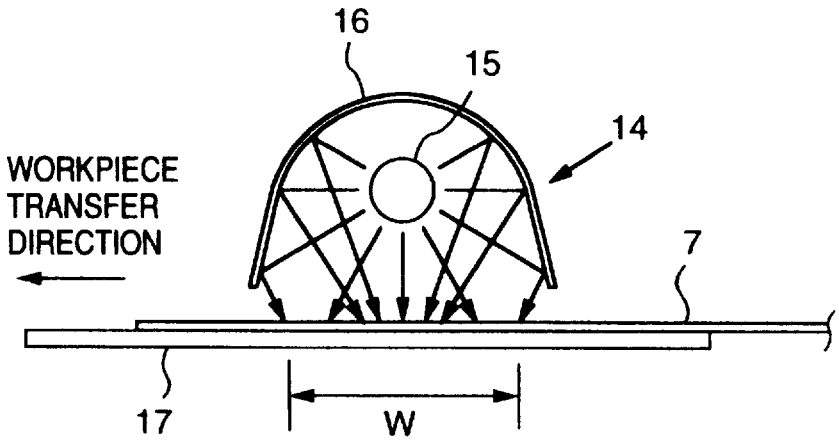
FIG. 5 is a schematic view showing a toner heating member usable in the toner printing machine of the present invention.

As shown in FIG. 5, the toner fixing device 14 as the claimed heating member has a heat source 15 (for example, halogen, xenon or mercury lamp, nichrome wire heater, infrared lamp or the like) generating a radiant heat energy and/or a high temperature gas (for example, the atmosphere) including a heat energy, and a reflection member 16 reflecting the radiant heat energy and/or the high temperature gas to be directed toward the toner image 3*c*. The heat source 15 is arranged on a focus line f1 of the reflection member 16.

Figure 6:
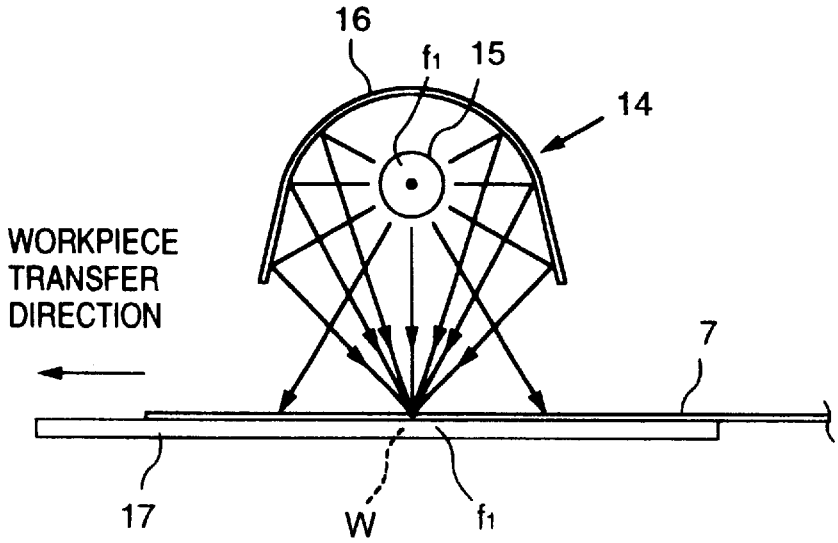
FIG. 6 is a schematic view showing another toner heating member usable in the toner printing machine of the present invention.

As shown in FIG. 6, another focus line f2 of the reflection member 16 may be arranged on the toner image 3*c* to form a heating width W into which sufficient heat energy for securely fixing the toner image 3*c* to the workpiece 7 is supplied or transmitted. Since the heating width W is narrower than the toner image transfer width M, the workpiece 7 must be moved relative to the toner fixing device 14 to fix the toner image 3*c* to the workpiece 7.

Figure 7:
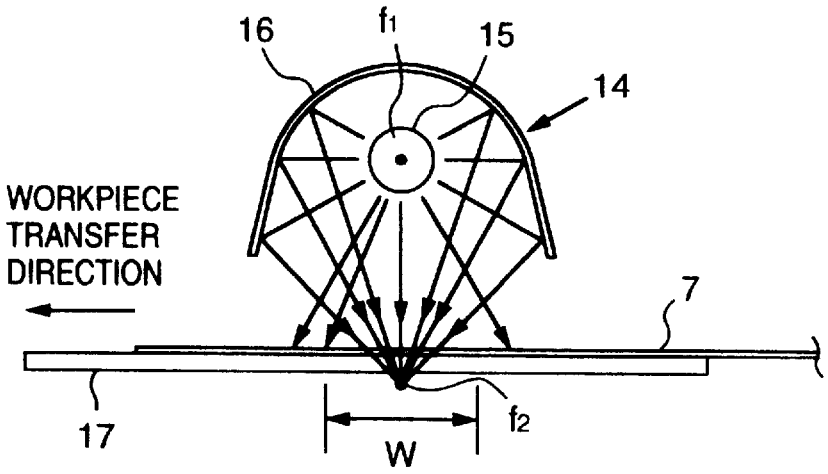
FIG. 7 is a schematic view showing another toner heating member usable in the toner printing machine of the present invention.

As shown in FIG. 7, the another focus line f2 of the reflection member 16 may be arranged below the toner image 3*c* to form the heating width. Since the heating width W is wider than the toner image transfer width M, the workpiece 7 may be moved or stationary relative to the toner fixing device 14 when fixing the toner image 3*c* to the workpiece 7 by the heat energy.

Figure 8:
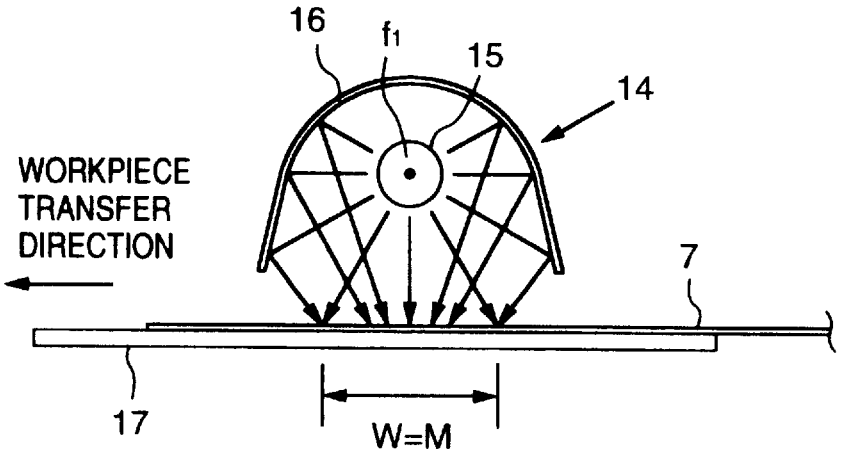
FIG. 8 is a schematic view showing another toner heating member usable in the toner printing machine of the present invention.

As shown in FIG. 8, the heating width W may be equal to the toner image transfer width M. The workpiece 7 may be moved or stationary relative to the toner fixing device 14 when fixing the toner image 3*c* to the workpiece 7 by the heat energy.

Figure 9:
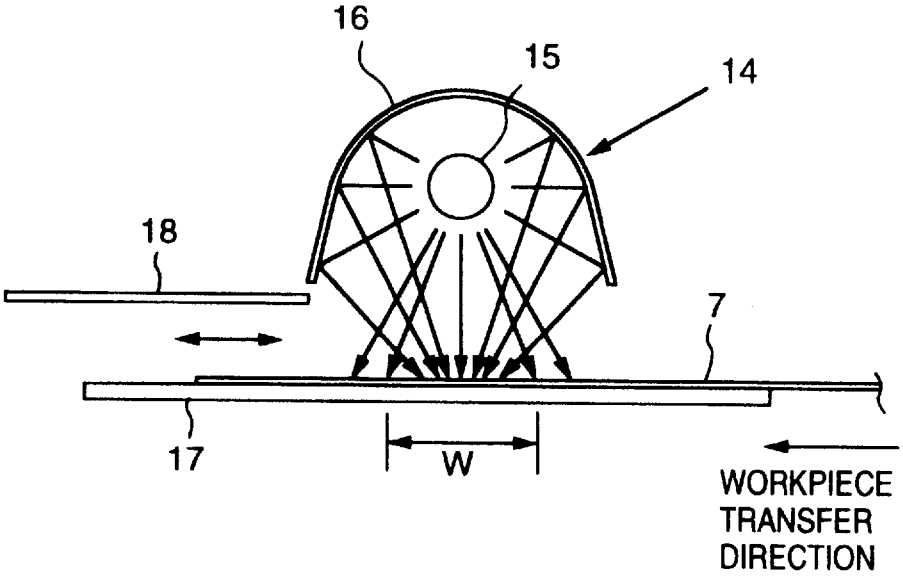
FIG. 9 is a schematic view showing a motion step of another toner heating member usable in the toner printing machine of the present invention.
Figure 10:
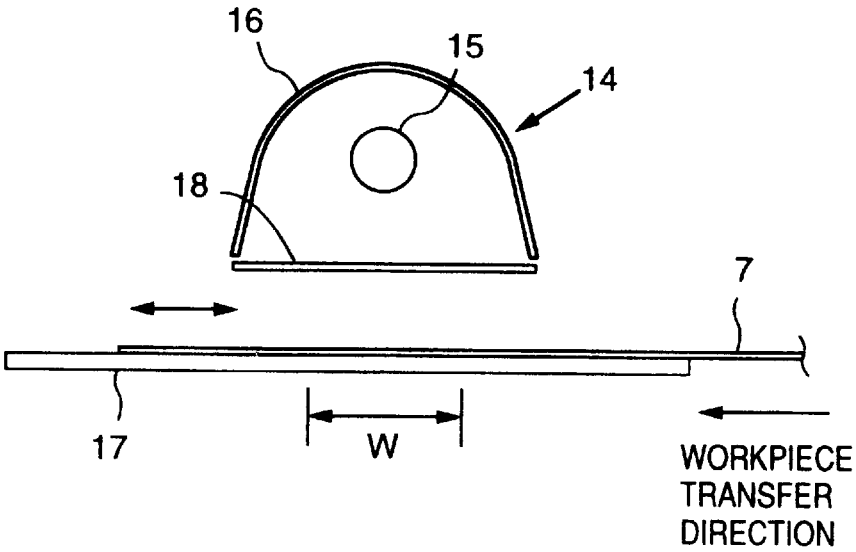
FIG. 10 is a schematic view showing another motion step of the toner heating member of FIG. 9.

As shown in FIGS. 9 and 10, a radiation interrupter member 18 movable relative to the toner fixing device 14 may be arranged to interrupt the heat energy transmission between the toner fixing device 14 and the workpiece 7 when an output of the heat source 15 is stopped or the supply of the heat energy to the workpiece 7 is not necessary, and to allow the heat energy transmission therebetween when the output of the heat source 15 is maintained or the supply of the heat energy to the workpiece 7 is necessary.

Figure 11:
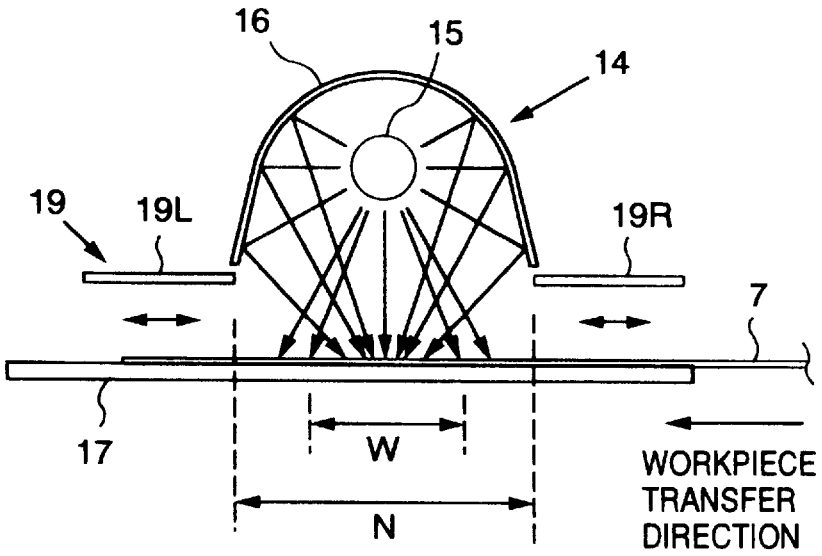
FIG. 11 is a schematic view showing a motion step of another toner heating member usable in the toner printing machine of the present invention.
Figure 12:
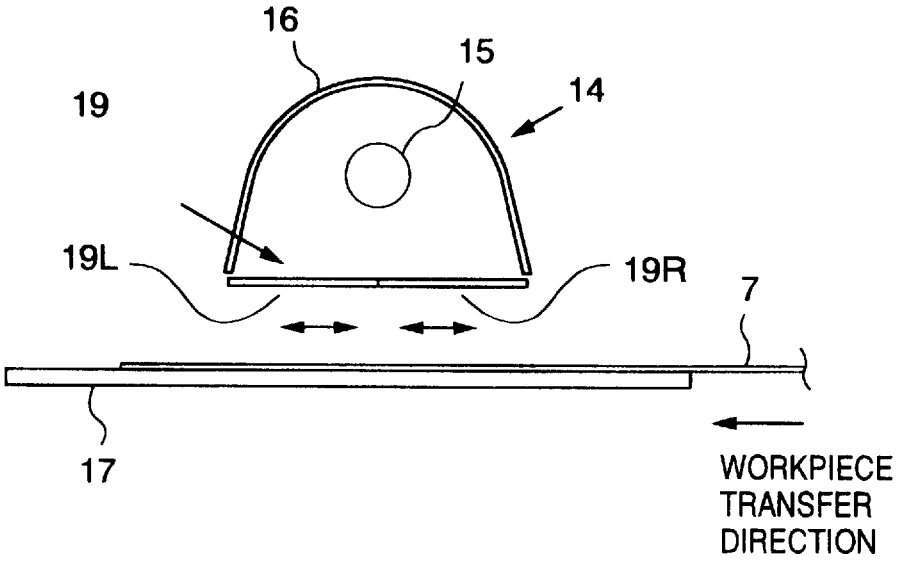
FIG. 12 is a schematic view showing another motion step of the toner heating member of FIG. 11.

As shown in FIGS. 10 and 11, a pair 19 of radiation interrupter shutters 19L and 19R movable relative to each other and to the toner fixing device 14 may be arranged to interrupt the heat energy transmission between the toner fixing device 14 and the workpiece 7 when an output of the heat source 15 is stopped or the supply of the heat energy to the workpiece 7 is not necessary, and to allow the heat energy transmission therebetween when the output of the heat source 15 is maintained or the supply of the heat energy to the workpiece 7 is necessary. A distance N between the radiation interrupter shutters 19L and 19R may be adjusted to set correctly the heating width W. This embodiment is preferable for a case in which the heating width W should be equal to the toner image transfer width M.

Figure 13:
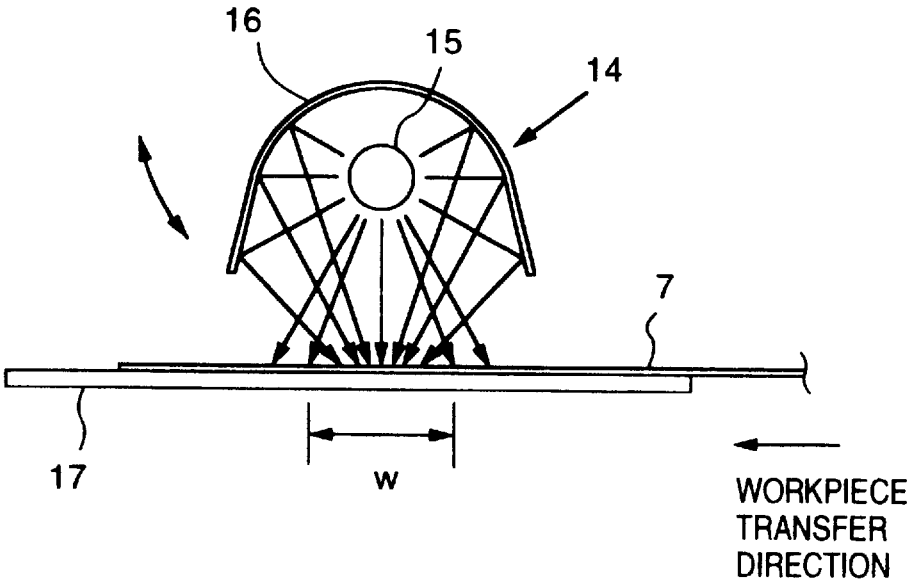
FIG. 13 is a schematic view showing a motion step of another toner heating member usable in the toner printing machine of the present invention.
Figure 14:
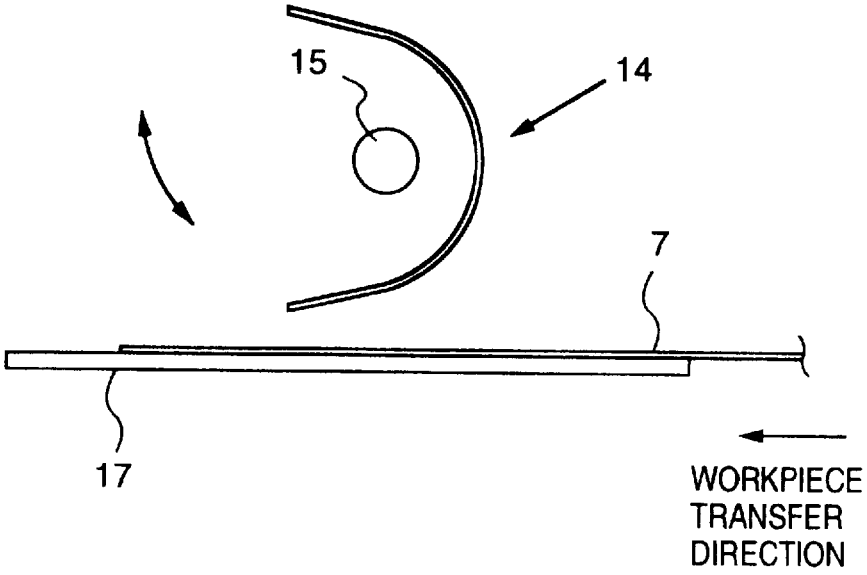
FIG. 14 is a schematic view showing another motion step of the toner heating member of FIG. 13.
Figure 15:
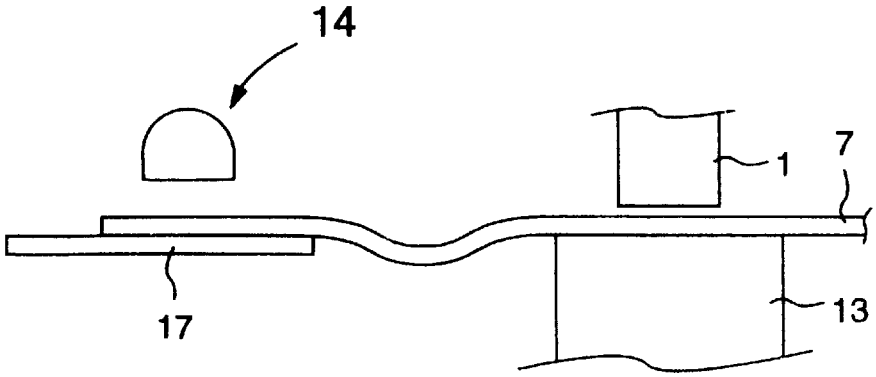
FIG. 15 is a schematic view showing a slack or bend of a workpiece usable in the toner printing machine of the present invention.

As shown in FIGS. 13 and 14, the reflection member 16 may be rotated around the heat source 15 to interrupt the heat energy transmission between the toner fixing device 14 and the workpiece 7 when an output of the heat source 15 is stopped or the supply of the heat energy to the workpiece 7 is not necessary, and to allow the heat energy transmission therebetween when the output of the heat source 15 is maintained or the supply of the heat energy to the workpiece 7 is necessary. A distance between the toner fixing device 14 and the workpiece 7 may be changed to adjust the heat energy transmission to the workpiece 7.

The electrostatic latent image may be formed by non-optical treatment, for example, thermal treatment for partial electrical discharge of the electrification of a non-photoconductive toner carrier, and the toner image may be formed by non-electrical treatment, for example, air-jet treatment for mechanical partial removal of coated toner on a non-electrical toner carrier.

What is claimed is:

1. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image and means for varying a distance between the heating member and toner image to control an amount of the heat energy to be supplied to the toner image.

2. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image; and means for moving a part of the workpiece facing to the image forming device intermittently in a workpiece transfer direction.

3. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image; and means for moving a part of the workpiece facing to the heating member intermittently in a workpiece transfer direction.

4. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image; and means for causing a slack of the workpiece between the image forming device and the heating member to absorb a difference between a movement of a part of the workpiece facing to the image forming device and a movement of another part of the workpiece facing to the heating member in a workpiece transfer direction.

5. A toner printing machine comprising:

an image forming device for forming a toner image on a workpiece; and a heating member for supplying heat energy to the toner image to be fixed to the workpiece preventing a contact heat energy transmission between the heating member and the toner image while the heat energy is supplied to the toner image, and supplying the heat energy to the toner image on a part of the workpiece while the part of the workpiece is substantially stationary relative to the heating member.

6. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image;

means for moving a part of the workpiece facing to the heating member intermittently relative to the heating member; and means for enabling maintenance of a supply of the heat energy from the heating member to the toner image when the part of the workpiece facing to the heating member is moved relative to the heating member, and subsequently causing a decrease in the supply of the heat energy before the part of the workpiece facing to the heating member stops relative to the heating member.

7. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image;

means for moving a part of the workpiece facing to the heating member intermittently relative to the heating member; and means for enabling an increase in a supply of the heat energy from the heating member to the toner image before the part of the workpiece facing to the heating member begins to move relative to the heating member, and subsequently for enabling a maintenance of the supply of the heat energy when the part of the workpiece facing to the heating member is moved relative to the heating member.

8. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image;

means for moving a part of the workpiece facing to the heating member intermittently relative to the heating member; and means for enabling maintenance of a supply of the heat energy from the heating member to the toner image when the part of the workpiece facing to the heating member is stationary relative to the heating member, and subsequently for enabling a decrease of the supply of the heat energy before the part of the workpiece facing to the heating member begins to move relative to the heating member.

9. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image;

means for moving a part of the workpiece facing to the heating member intermittently relative to the heating member; and means for enabling an increase in a supply of the heat energy from the heating member to the toner image before the part of the workpiece facing to the heating member becomes stationary relative to the heating member, and subsequently for enabling a maintenance of the supply of the heat energy when the part of the workpiece facing to the heating member is stationary relative to the heating member.

10. A toner printing machine comprising:

an image forming device for forming a toner image on a workpiece;

a heating member for supplying heat energy to the toner image to be fixed to the workpiece and preventing a contact heat energy transmission between the heating member and the toner image while the heat energy is supplied to the toner image; and means for restraining a supply of the heat energy from the heating member to the toner image when a part of the workpiece facing to the heating member is being moved relative to the heating member.

11. A toner printing machine comprising:

an image forming device for forming a toner image on a workpiece intermittently toner-transfer-width by toner-transfer-width; and a heating member for supplying heat energy to the toner image to be fixed to the workpiece preventing a contact heat energy transmission between the heating member and the toner image while the heat energy is supplied to the toner image, and performing a supply of the heat energy to the toner image with a heating width on the toner image, said heating width being not less than the toner-transfer-width, in a workpiece transfer direction.

12. A toner printing machine comprising:

an image forming device for forming a toner image on a workpiece intermittently toner-transfer-width by toner-transfer-width; and a heating member for supplying heat energy to the toner image to be fixed to the workpiece, preventing a contact heat energy transmission between the heating member and the toner image while the heat energy is supplied to the toner image, and performing a supply of the heat energy from the heating member to the toner image with a heating width on the toner image, said heating width being less than the toner-transfer-width, in a workpiece transfer direction.

13. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image; and varying a distance between the heating member and toner image to control an amount of the heat energy to be supplied to the toner image.

14. A toner printing method comprising:

employing an image forming device to form a toner image on a workpiece;

supplying heat energy from a heating member to the toner images to be fixed to the workpiece and preventing a contact heat energy transmission between the heating member and the toner image while the heat energy is supplied to the toner image; and moving a part of the workpiece facing to the image forming device intermittently in a workpiece transfer direction.

15. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image; and moving a part of the workpiece facing to the heating member intermittently in a workpiece transfer direction.

16. A toner printing method comprising:

employing an image forming device to form a toner image on a workpiece;

supplying heat energy from a heating energy transmission between the heating member and the toner image while the heat energy is supplied to the toner image; and causing a slack of the workpiece between the image forming device and the heating member to absorb a difference between a movement of a part of the workpiece facing to the image forming device and a movement of another part of the workpiece facing to the heating member in a workpiece transfer direction.

17. A toner printing method comprising:

forming a toner image on a workpiece; and supplying heat energy from a heating member to the toner image to be fixed to the workpiece, preventing a contact heat energy transmission between the heating member and the toner image while the heat energy is supplied to the toner image, and supplying the heat energy to the toner image on a part of the workpiece while the part of the workpiece is substantially stationary relative to the heating member.

18. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image;

moving a part of the workpiece facing to the heating member intermittently relative to the heating member; and enabling maintenance of a supply of the heat energy from the heating member to the toner image when the part of the workpiece facing to the heating member is moved relative to the heating member, and subsequently causing a decrease in the supply of the heat energy before the part of the workpiece facing to the heating member stops relative to the heating member.

19. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image;

moving a part of the workpiece facing to the heating member intermittently relative to the heating member; and enabling an increase in a supply of the heat energy from the heating member to the toner image before the part of the workpiece facing to the heating member begins to move relative to the heating member, and subsequently enabling a maintenance of the supply of the heat energy when the part of the workpiece facing to the heating member is moved relative to the heating member.

20. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image;

moving a part of the workpiece facing to the heating member intermittently relative to the heating member; and enabling maintenance of a supply of the heat energy from the heating member to the toner image when the part of the workpiece facing to the heating member is stationary relative to the heating member, and subsequently enabling a decrease of the supply of the heat energy before the part of the workpiece facing to the heating member begins to move relative to the heating member.

21. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image;

moving a part of the workpiece facing to the heating member intermittently relative to the heating member; and enabling an increase in a supply of the heat energy from the heating member to the toner image before the part of the workpiece facing to the heating member becomes stationary relative to the heating member, and subsequently enabling a maintenance of a supply of the heat energy when the part of the workpiece facing to the heating member is stationary relative to the heating member.

22. A toner printing method comprising:

forming a toner image on a workpiece;

supplying heat energy from a heating member to the toner image to be fixed to the workpiece and preventing a contact heat energy transmission between the heating member and the toner image while the heat energy is supplied to the toner image; and restraining a supply of the heat energy from the heating member to the toner image when a part of the workpiece facing to the heating member is being moved relative to the heating member.

23. A toner printing method comprising:

forming a toner image on a workpiece intermittently toner-transfer-width by toner-transfer-width; and supplying heat energy from a heating member to the toner image to be fixed to the workpiece, preventing a contact heat energy transmission between the heating member and the toner image while the heat energy is supplied to the toner image, and supplying the heat energy to the toner image with a heating width on the toner image, said heating width being not less than the toner-transfer-width, in a workpiece transfer direction.

24. A toner printing method comprising:

forming a toner image on a workpiece intermittently toner-transfer-width by toner-transfer-width; and supplying heat energy from a heating member to the toner image to be fixed to the workpiece, preventing a contact heat energy transmission between the heating member and the toner image while the heat energy is supplied to the toner image, and supplying the heat energy from the heating member to the toner image with a heating width on the toner image, said heating width being less than the toner-transfer-width, in a workpiece transfer direction.

* * * * *